US012187495B2

(12) United States Patent
Jesberg et al.

(10) Patent No.: US 12,187,495 B2
(45) Date of Patent: Jan. 7, 2025

(54) CLOSURE CAP AND VESSEL WITH SUCH A CLOSURE CAP AND METHOD FOR PRODUCING THE CLOSURE CAP

(71) Applicant: Seidel GmbH & Co. KG, Marburg (DE)

(72) Inventors: Silke Jesberg, Wetter (DE); Andreas Franz Christian Ritzenhoff, Marburg (DE); Michael Kurz, Neustadt (DE)

(73) Assignee: Seidel GmbH & Co. KG, Marburg (DE)

( * ) Notice: Subject to any disclaimer, the term of this patent is extended or adjusted under 35 U.S.C. 154(b) by 0 days.

(21) Appl. No.: 17/844,806

(22) Filed: Jun. 21, 2022

(65) Prior Publication Data

US 2022/0411137 A1 Dec. 29, 2022

(30) Foreign Application Priority Data

Jun. 21, 2021 (DE) ..... 10 2021 116 007.3

(51) Int. Cl.
*B65D 41/04* (2006.01)

(52) U.S. Cl.
CPC ..... *B65D 41/0414* (2013.01); *B65D 41/0492* (2013.01); *B65D 2543/00092* (2013.01); *B65D 2543/00277* (2013.01); *B65D 2543/00296* (2013.01); *B65D 2543/00314* (2013.01); *B65D 2543/00537* (2013.01); *B65D 2543/0099* (2013.01)

(58) Field of Classification Search
CPC ..... B65D 41/0414; B65D 2543/00314; B65D 2543/00277; B65D 2543/00296; B65D 41/0492
See application file for complete search history.

(56) References Cited

U.S. PATENT DOCUMENTS

| | | | | |
|---|---|---|---|---|
| 3,933,267 | A * | 1/1976 | Rohde | B65D 41/0435 215/350 |
| 4,011,962 | A * | 3/1977 | Favell | B65D 41/62 215/334 |
| 4,241,840 | A * | 12/1980 | Willis | B65D 50/041 215/220 |
| 2003/0102281 | A1* | 6/2003 | Ryall | B65D 41/3438 215/346 |
| 2008/0035600 | A1* | 2/2008 | McGeough | B65D 41/0414 264/487 |
| 2009/0084753 | A1* | 4/2009 | Ramos | B65D 41/02 425/114 |

* cited by examiner

*Primary Examiner* — James N Smalley
(74) *Attorney, Agent, or Firm* — Dickinson Wright PLLC; Andrew D. Dorisio

(57) ABSTRACT

The invention relates to a closing cap (11) and a method for producing a closing cap for a container (10) for receiving cosmetic creams, liquids or pasty substances, such as in particular mascara, the closing cap (11) being designed as a material hybrid and having a connective area for establishing a connection realized as a screw connection, bayonet connection or the like between the closing cap (11) and the container (10), the connective area being formed on an inner side (15) of a base body (12) made of metal, plastic or ceramics. The connective area has a plastic material as a contacting material in merely a portion for forming a physical contact between the closing cap (11) and the container (10) and the remaining portions are made of the same material as the base body (12).

19 Claims, 10 Drawing Sheets

CLOSURE CAP AND VESSEL WITH SUCH A CLOSURE CAP AND METHOD FOR PRODUCING THE CLOSURE CAP

TECHNICAL FIELD

The invention at hand relates to a closing cap for a container for receiving cosmetic creams, liquids or pasty substances, such as in particular mascara, the closing cap being designed as a material hybrid and having a connective area for establishing a connection realized as a screw connection, bayonet connection or the like between the closing cap and the container, the connective area being formed on an inner side of a base body made of metal, plastic or ceramics. In addition, the invention relates to a container provided with a closing cap of this kind and to a method for producing a closing cap.

BACKGROUND

Closing caps of the kind mentioned above which are designed as material hybrids have become known in different embodiments, an approach for enabling recycling closing caps of this kind consisting of designing the closing caps such that components of the closing cap made of different materials are connected to each other in a non-permanent manner when producing the closing cap in order to be able to separate an inner cap, which is made of plastic, for example, and simultaneously forms a cap thread of the closing cap, from an aluminum outer cap of the closing cap as a prerequisite for recycling different materials. Such a design of a closing cap designed as a material hybrid presumes producing the individual components independently of each other, which have to be assembled in another separate assembling step. For recycling a closing cap of this kind, this means renewed handling of the closing cap is required in order to separate the components from each other.

Another possible approach consists of forgoing forming mechanical intersections between the components which enable separating the components for recycling purposes and instead eliminating one or several of the materials combined with each other, meaning plastic portions are detached or burned, for example, in order to be able to recycle the metal portions. This leads to a not insignificant volume fraction of the closing cap consisting of plastic, for example, potentially being sacrificed which could otherwise be resupplied in a recycling process, thus leading to a rather negative eco-balance as a result.

SUMMARY

The object of the invention at hand is to propose a closing cap which is designed as a material hybrid and enables easy recycling with minimal negative impact on the eco-balance.

In order to attain this object, the closing cap according to the invention has the features of claim 1.

According to the invention, the closing cap has a connective area for establishing a connection realized as a screw connection, bayonet connection or the like between the closing cap and the container, the connective area being formed on an inner side of a base body made of metal, plastic or ceramics, the connective area having a plastic material as a contacting material in merely a portion for forming a physical contact between the closing cap and the container and the remaining portions being made of the same material as the base body.

In the event that the base body of the closing cap is also made of a plastic material, the plastic material used as a contacting material differs from the plastic material of the base body in its chemical and/or physical properties. Using a contacting material made of a plastic material merely in a portion of the connective area, with the remaining portions of this portion being made of the same material as the base body, requires merely the elimination of a relatively slight volume or weight fraction of the closing cap in preparation for recycling the material used for the base body compared to a closing cap whose entire connective area, for instance, consists of plastic material different to the plastic material of the base body. In particular in the case when the connective area consists of a connective area made overall of a plastic material, the plastic portion to be sacrificed can be significantly reduced as a prerequisite for a recycling process of the base body material.

In this context, it is presumed that the essential function of the plastic material used in the connective area consists of forming a friction partner when establishing the connection between the closing cap and the container, the friction partner positively impacting the friction behavior in the case of a screw connection between the closing cap and a metal thread of the container, leading to the user's correspondingly positive haptic perception during the opening and closing process of the container.

Preferably, the volume or weight fraction of the contacting material is less than or equal to 8%, particularly preferably less than or equal to 5%.

When the contacting material consists of a thermoplastic material, such as in particular TPE (thermoplastic elastomers), which is soft compared to the material of the closing cap, the advantages described above are attained to a particular extent.

When the contacting material forms a thread turn of a cap thread formed on the inner side of the base body, the invention can be realized particularly easily in this case if the connective area serves for establishing a screw connection.

When the contacting material moreover forms a cap seal between the base body and an opening edge of a container opening of the container, the exact same contacting material can be used advantageously for forming a thread turn and for forming a seal surface.

It is particularly preferable when the seal surface is an annular or circular surface.

When the thread turn and the cap seal are made of a continuous contacting material unit, the thread turn and the cap seal can be produced particularly economically in a shared injection molding process.

A particularly effective use of the contacting material both for attaining the advantageous haptic perception mentioned above and regarding as large a minimization as possible of the material portion of the contacting material in the overall volume or overall weight of the closing cap can be attained if the thread turn has a profile having profile flanks tapering off in the transition area to the surface of the base body.

In particular regarding further increasing the possible minimization of the use of plastic material as a contacting material, it is advantageous if the thread turn is made up of thread turn segments spaced apart from each other in the direction of the thread turn.

In each case, it has proven advantageous regarding the desired realization of the positive haptic perception and regarding the minimization of the used contacting material when a depression bottom of a thread depression, which is formed between axially adjacent flanks of the thread turn, does not have contacting material.

It is particularly advantageous when the thread turn is realized as an acme thread.

If the contacting material forms contacting protrusions on the inner side of the base body between thread turn segments formed on the inner side of the base body, it is possible to form the thread turn in the connective area of the base body from the same material as the base body and to limit the use of the contacting material to forming the contacting protrusions between the thread turn segments.

Preferably, a cap seal between the base body and an opening edge of a container opening of the container is also made of the contacting material in this case.

It is particularly advantageous when the thread turn segments are made of the same material as the base body, making it possible to further reduce the amount of the used contacting material.

If the contacting protrusions are formed as a plurality of contacting material strands which extend within the connective area in the axial direction, a consistent circumferential support of the closing cap on the container can be achieved when the contacting material strands are equally distributed around the circumference for an opening and closing process, which positively effects the user's haptic perception.

As in the case of the previously mentioned thread turn or thread turn segments made of the contacting material and disposed on the inner side of the base body, the contacting material strands can be produced in a molding process, in particular an injection molding process, the thread turn and/or the contacting material strands being able to be formed on the base body itself in connection with the cap seal and the thread turn and/or the contacting material strands thus being able to form a contacting material unit in conjunction with the cap seal.

It is particularly advantageous in the case of the contacting material strands when a central part combining the individual contact strands serves for forming a cap seal.

When the base body of the closing cap forms an inner cap disposed in an outer cap, complex embodiments of a closing cap are possible based on the base body provided with the contacting material, these complex embodiments enabling further design options owing to, for example, an outer cap formed independently of the base body.

The container according to the invention has the features of claim 18.

The method according to the invention for producing a closing cap intends according to claim 19 that the contacting material is applied to the surface of the inner side of the base body in a coating process so that consequently a substance-to-substance unit between the contacting material and the material of the base body is produced and the base body forms a carrier substrate on the inner side of the base body when forming the contacting material.

If the contacting material is applied in a molding process, the base body forms a part of a molding tool, which comes to pass in particular in the instance when the contacting material is applied to the surface of the inner side of the base body in an injection molding process.

BRIEF DESCRIPTION OF THE DRAWINGS

In the following, advantageous embodiments of the closing cap are described in further detail using the illustrations.

DETAILED DESCRIPTION

Figure 1:
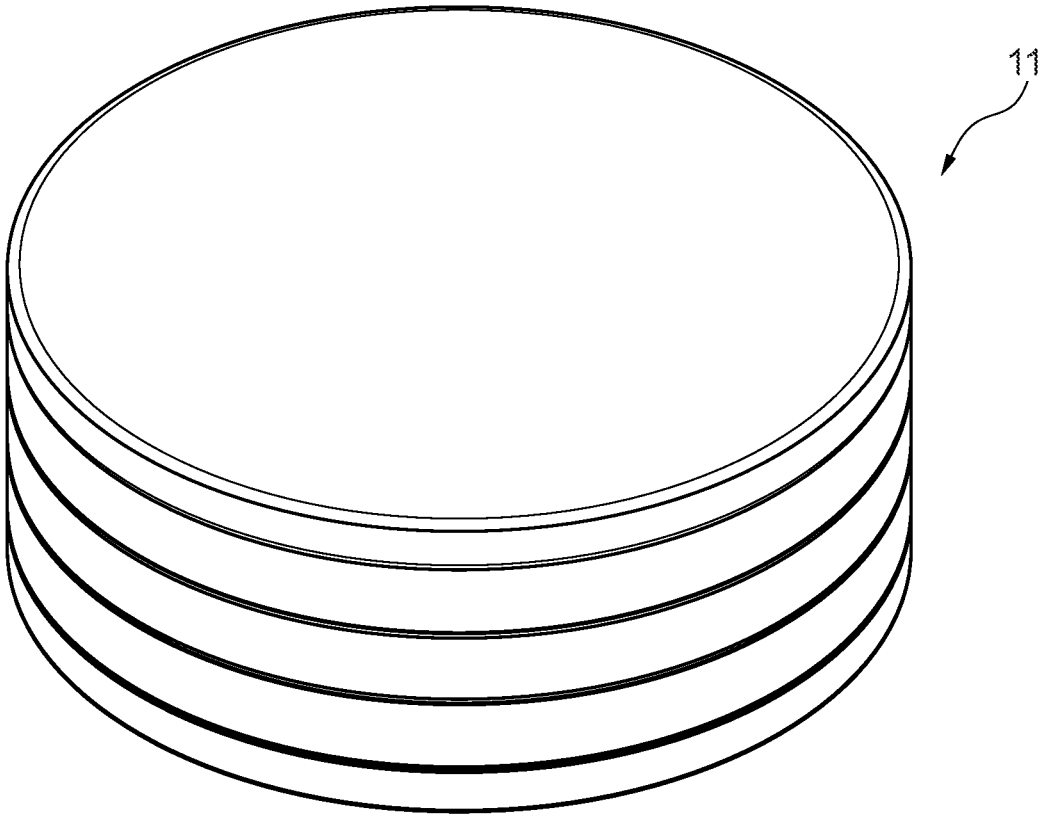
FIG. 1 shows an isometric view and top view of a closing cap in a first embodiment.
Figure 2:
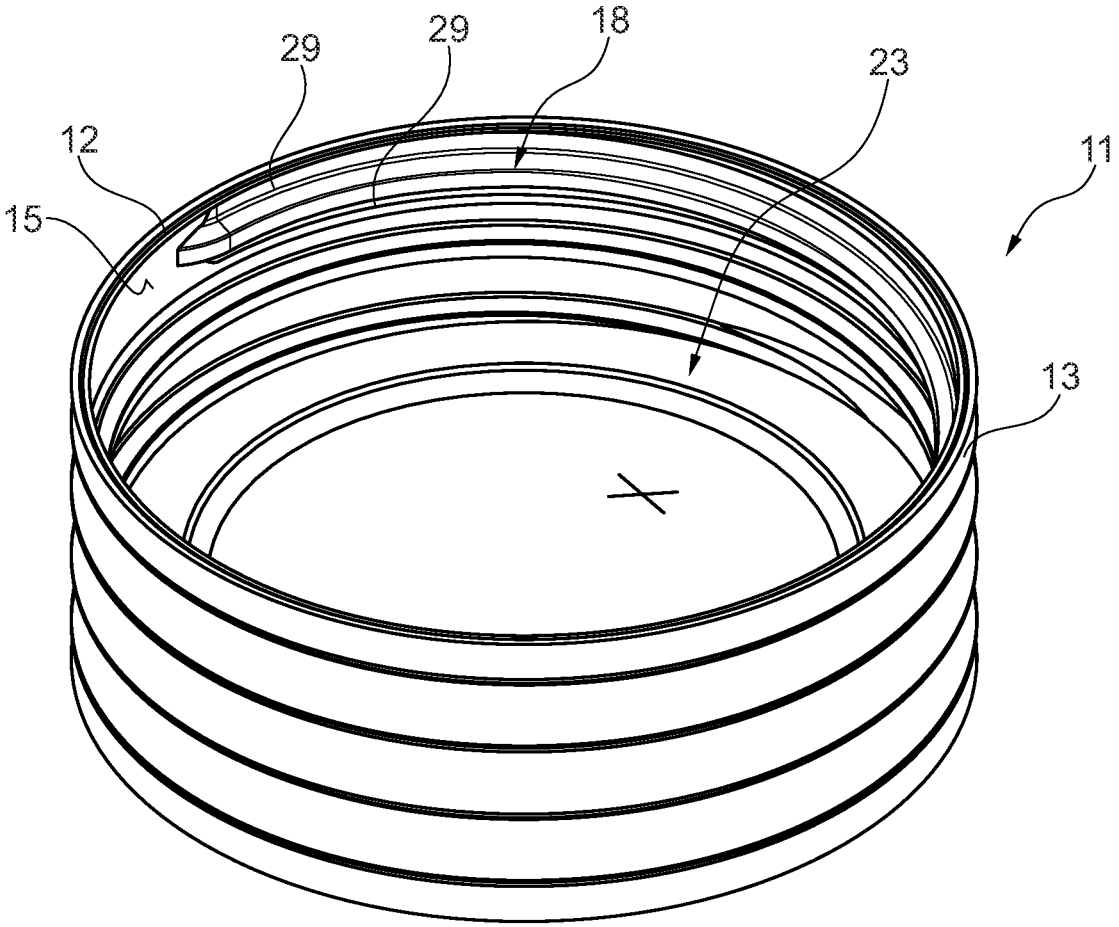
FIG. 2 shows an isometric view and bottom view of the closing cap shown in FIG. 1.

In FIGS. 1 to 5, a first embodiment of a closing cap 11 is shown which is shown in combination with a container 10 designed as a pot in this instance. In the instance at hand, closing cap 11 has a total of four components, a cap insert 14 realized as a cap weight in this instance being received between a base body 12 realized as an inner cap and an outer cap 13, cap insert 14 contributing to the design, which essentially influences the haptic perception of closing cap 11, together with outer cap 13 and for this purpose supplementing base body 12 provided with a cap thread 16 and a cap seal 17 on an inner side 15.

Figure 3:
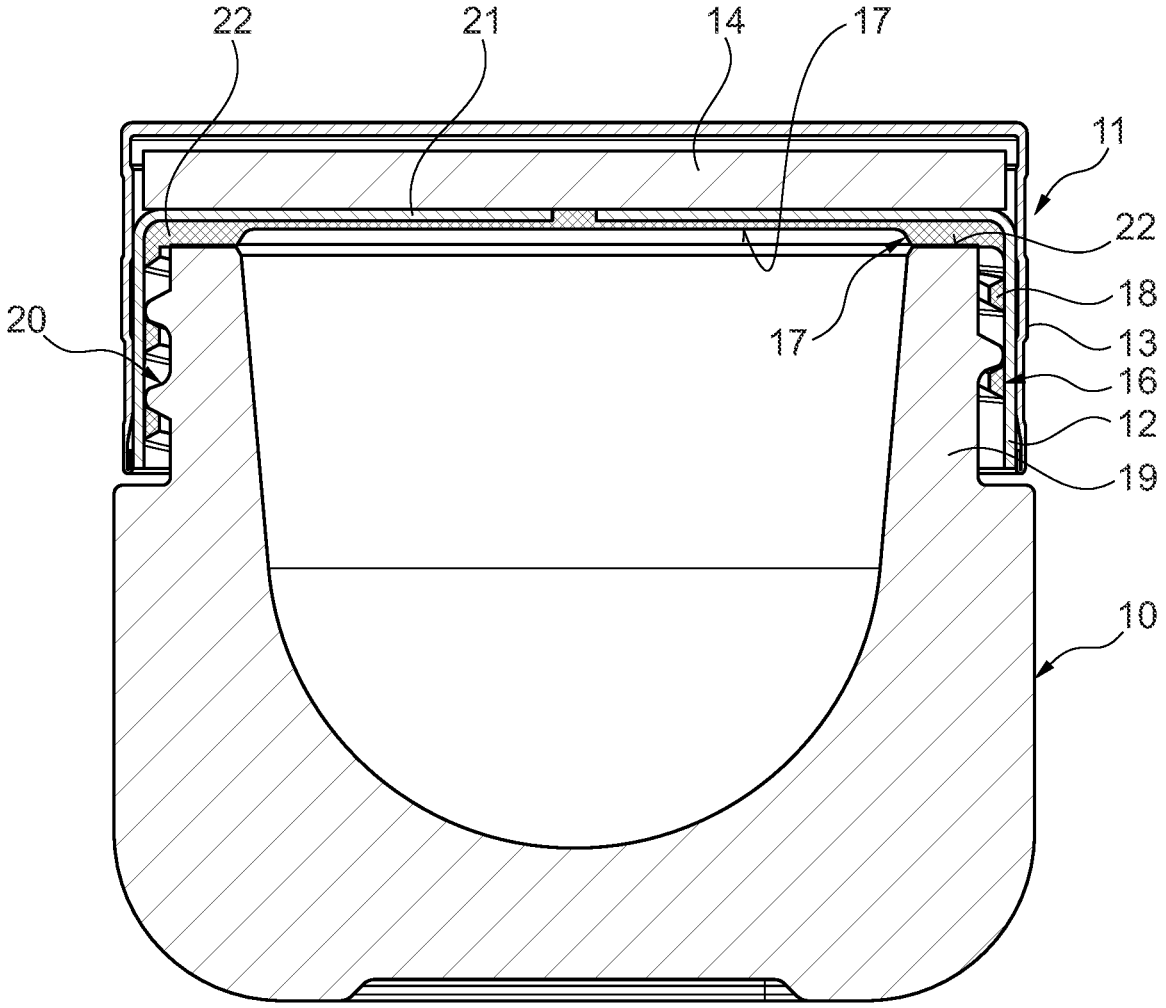
FIG. 3 shows a sectional view of a container provided with the closing cap shown in FIG. 1.

As FIG. 3 shows, a thread turn 18 of cap thread 16 extends over a connective area formed on inner side 15 of base body 12, thread turn 18 being engaged with a container thread 20 formed on a container neck 19 of container 10. In the closed configuration of container 10 shown in FIG. 3, cap seal 17 disposed on a cap bottom 21 of base body 12 designed as an inner cap abuts against an opening edge 34 of container 10 in a sealing manner.

In the case at hand, both thread turn 18 of cap thread 16 and cap seal 17 are made of a contacting material 22 which is formed on inner side 15 of base body 12, which consists of aluminum in consistence with outer cap 13 in the present instance, in an injection molding process. As in particular a combined view of FIGS. 4 and 5 clearly shows, thread turn 18 and cap seal 17 form a contacting material unit 23 in the present case which is disposed on inner side 15 of base body 12, base body 12 being able to serve in such a manner as part of a molding tool if contacting material unit 23 is produced in an injection molding process that base body 12 in conjunction with a mold core 32 (indicated by hatched lines in FIG. 4) inserted in base body 12 forms a mold nest for contacting material unit 23 when producing contacting material unit 23.

Figure 4:
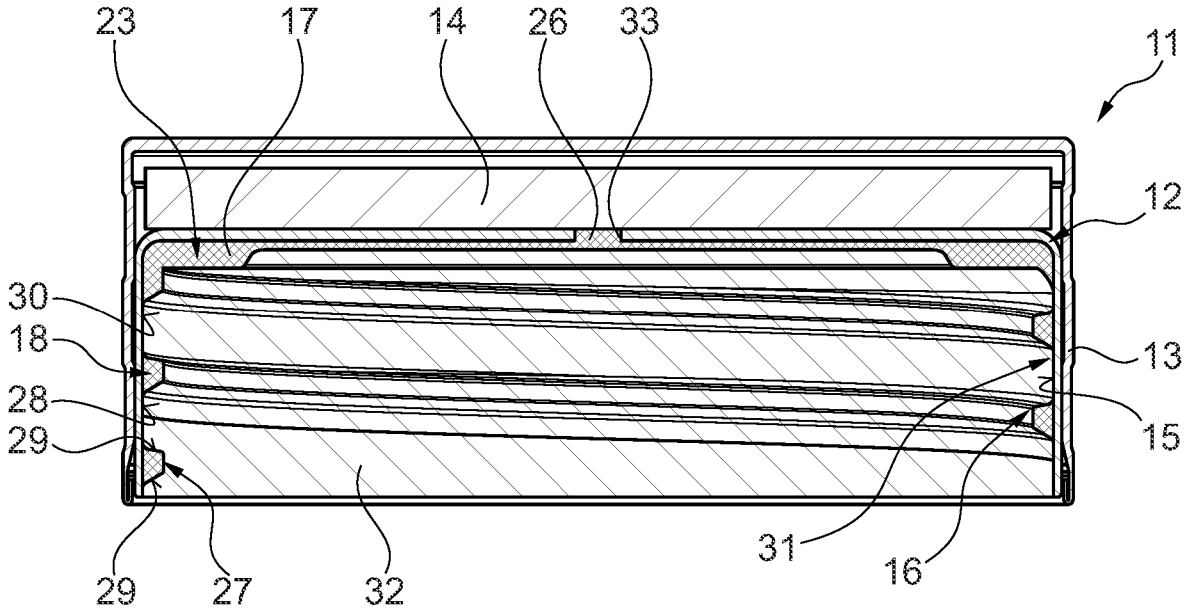
FIG. 4 shows an individual view of the closing cap shown in FIG. 3.

Contacting material 22 is inserted into the molding nest through a central bore 33 formed in cap bottom 21 of base body 12 such that, as shown in FIG. 4, contacting material unit 23 has a gate 26 formed in central bore 25 after contacting material unit 23 is produced.

As in particular FIG. 4 shows, thread turn 18 realized as an acme thread in this instance has a profile 27 having profile flanks 29 tapering off in the transition area to a surface 28 of inner side 15 of base body 12, a depression bottom 30 of a thread depression 31 formed between axially adjacent profile flanks 20 not having contacting material, meaning in the present instance that surface 28 is made of the same material as base body 12, i.e., aluminum in this instance.

As FIG. 3 clearly shows in the exemplary embodiment shown in the present case, a physical contact is obtained between closing cap 11 screwed onto container neck 19 of container 10 and container 10 exclusively via contacting material 22 used for producing thread turn 18 and cap seal 17, whereby no metallic contacting takes place between closing cap 11 and container 10 when screwing and unscrewing the closing cap despite base body 12 being made of aluminum and a possibly consistent design of container 10 being made of aluminum. Indeed, the user's haptic perception is determined by the contacting and friction behavior of contacting material 22 with respect to the material of container 10 during the opening and closing process, a snug fit of closing cap 11 in conjunction with a friction resistance perceived as pleasant when screwing and unscrewing container 10 being achieved in particular when using TPE as a plastic material, in particular for a friction pairing consisting of TPE as a contacting material and aluminum or a comparatively hard plastic material for container 10.

In any case, the material pairing can be chosen such that on the one hand, a good bond of contacting material 22 to, for example, metal, plastic, glass or ceramics and on the other hand good friction and sliding properties can be set in order to also attenuate in particular sound when closing or opening container 10.

The connective area, i.e., the area on inner side 15 of base body 12, via which thread turn 18 extends, can be designed in such a manner that the entire forces and torques are carried by contacting material 22, as is the case in the exemplary embodiment shown in FIG. 3.

To minimize sound and secure closing cap 11 against becoming loose, a pre-tensioned form of the closing cap can be used which is modeled after the Reuleaux triangle. The flexibility of base body 12 serves as a spring and compensates tolerances in the gaps between closing cap 11 and container 10, meaning a qualitative haptic feel can be attained in particular independently of the environmental temperature.

Figure 8:
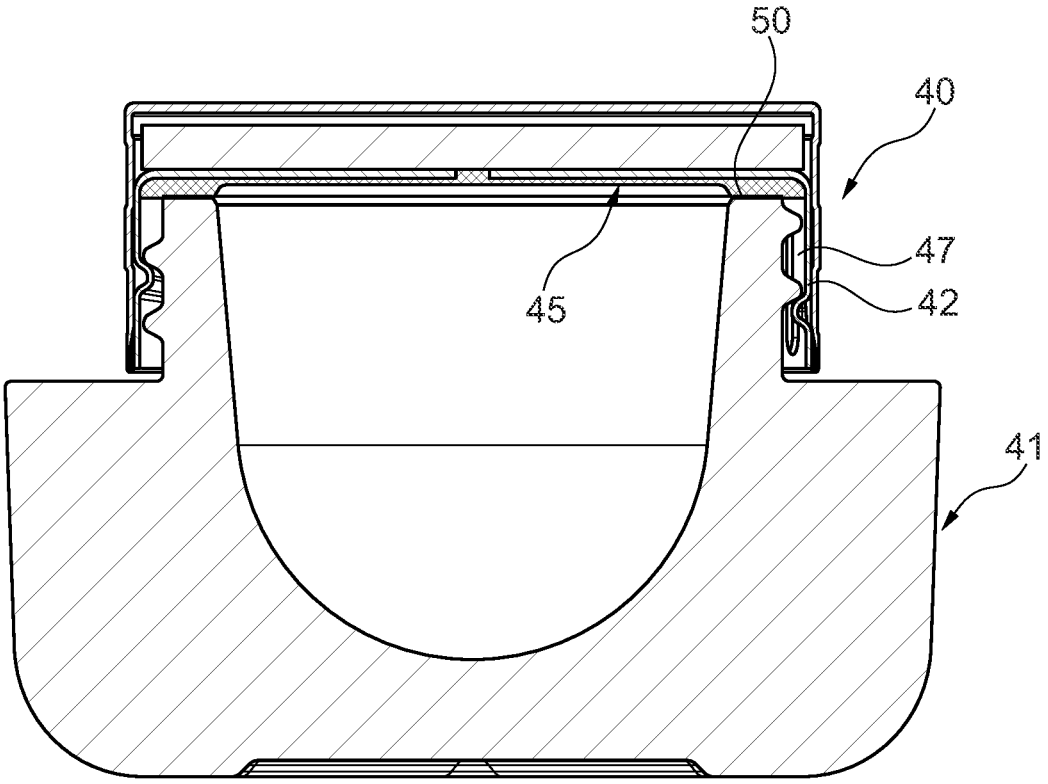
FIG. 8 shows a sectional view of a container having the closing cap shown in FIGS. 6 and 7.
Figure 9:
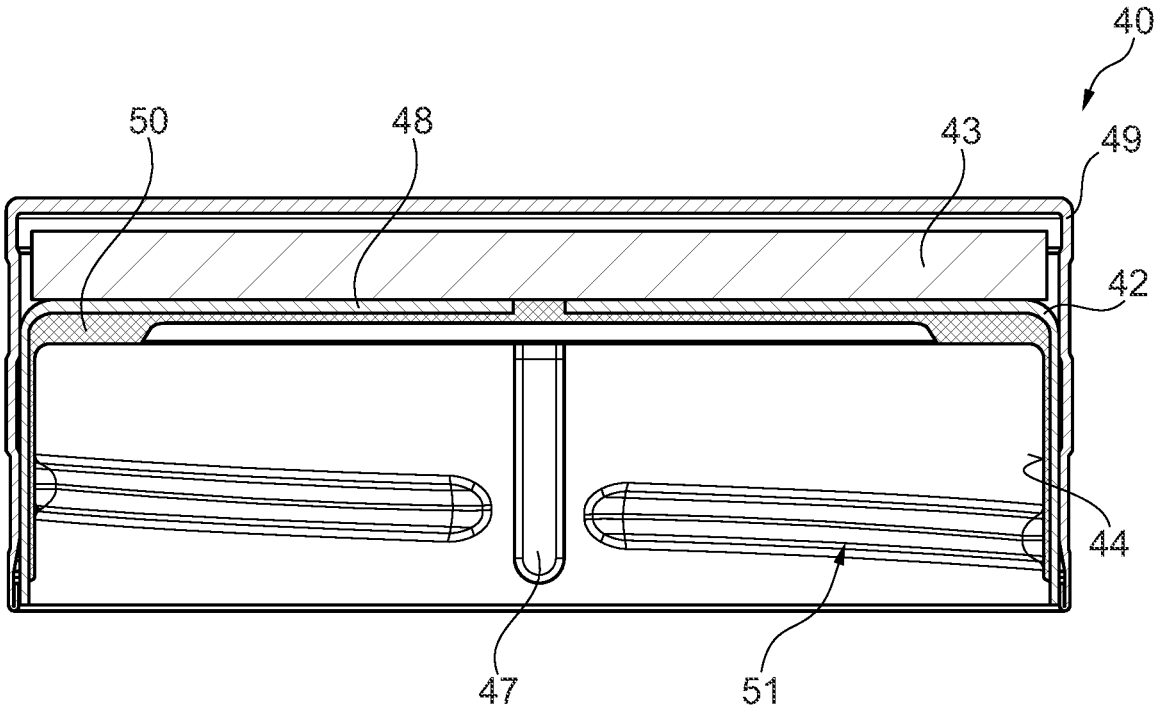
FIG. 9 shows an individual view of the closing cap shown in FIG. 8.

In FIGS. 6 to 10, another embodiment of closing cap 40 is shown which is shown in combination with a container 41 in FIG. 8. As in particular FIG. 9 shows, closing cap 40 has a base body 42 which is designed as an inner cap of closing cap 40 in concordance with closing cap 11 shown in referenced FIGS. 1 to 5, a cap insert 43 also realized as a cap weight being provided between base body 42 and an outer cap 49 also made of aluminum in concordance with base body 42.

Figure 10:
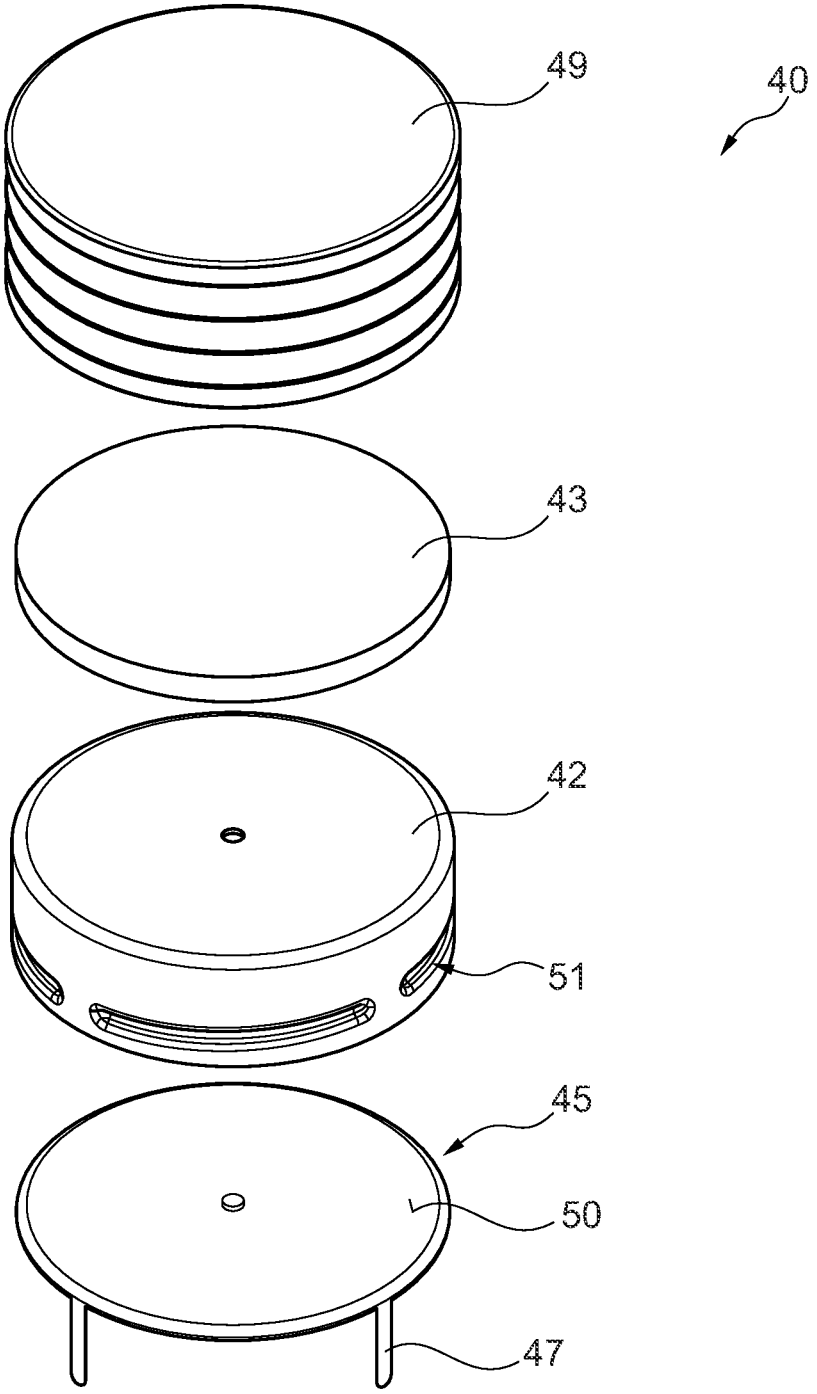
FIG. 10 shows an exploded view of the closing cap shown in FIGS. 6 to 9.

As in particular a combined view of FIGS. 9 and 10 clearly shows, base body 42 is provided with a contacting material unit 45 on its inner side 44, contacting material unit 45 also preferably being applied on inner side 45 of base body 42 in an injection molding process and having a plurality of contacting material strands 47 which axially extend across a connective area formed on inner side 44 and are connected to a central part of contacting material unit 45 disposed on a cap bottom 48 of base body 42, the central part forming a cap seal 48.

Figure 5:
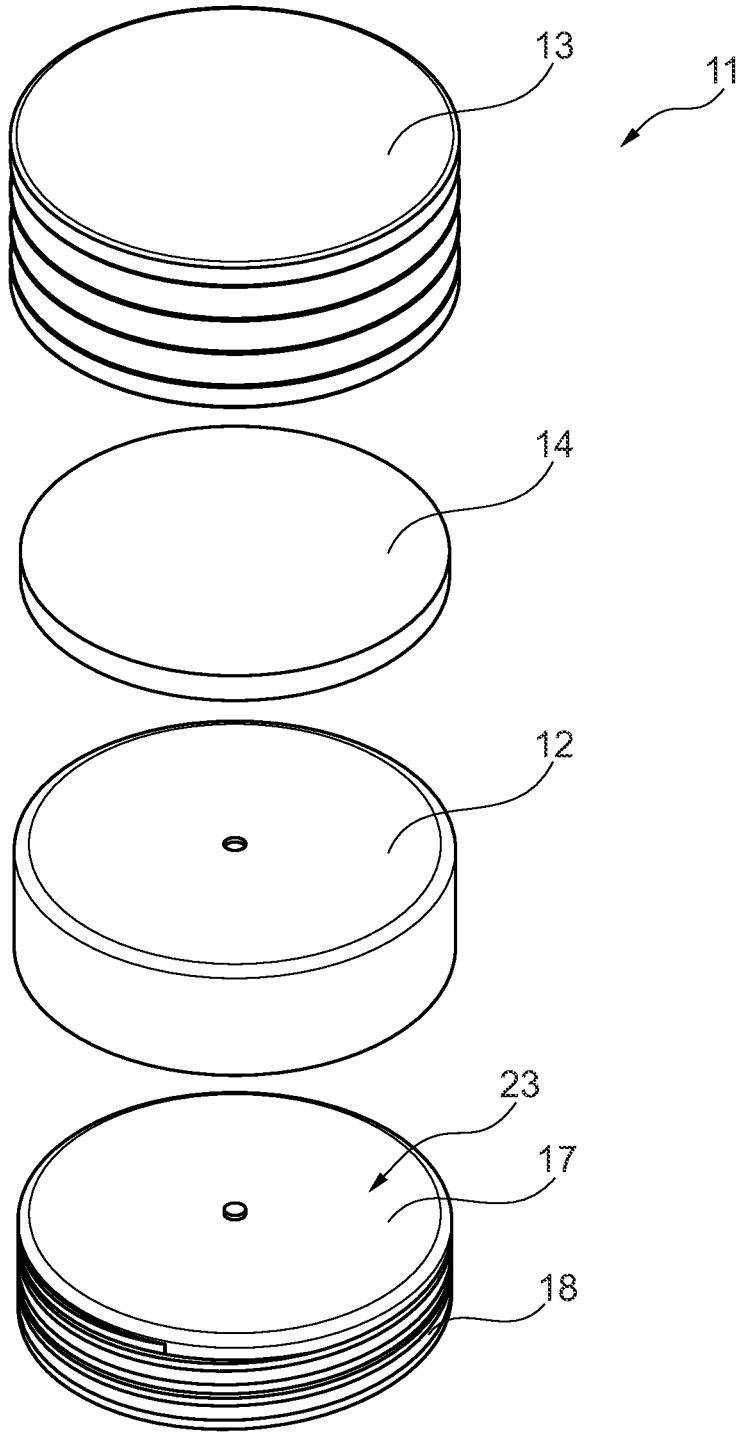
FIG. 5 shows an exploded view of the closing cap shown in FIGS. 1 to 4.
Figure 6:
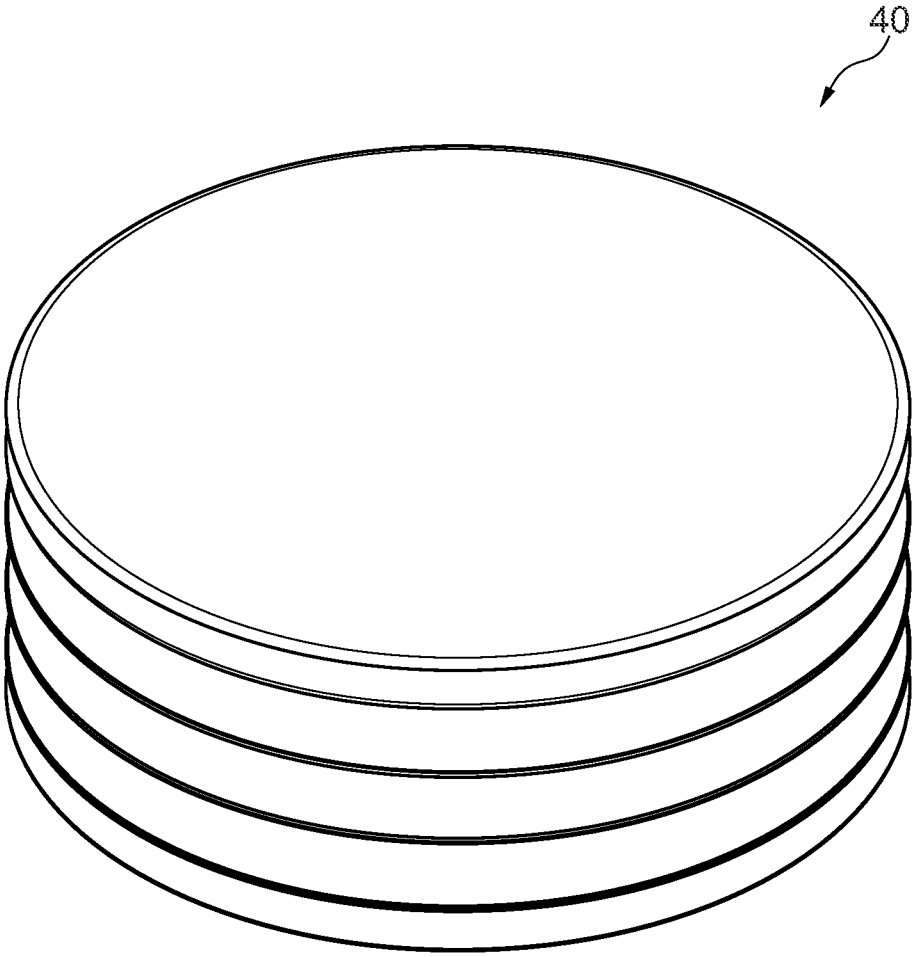
FIG. 6 shows an isometric view of a closing cap in another embodiment.
Figure 7:
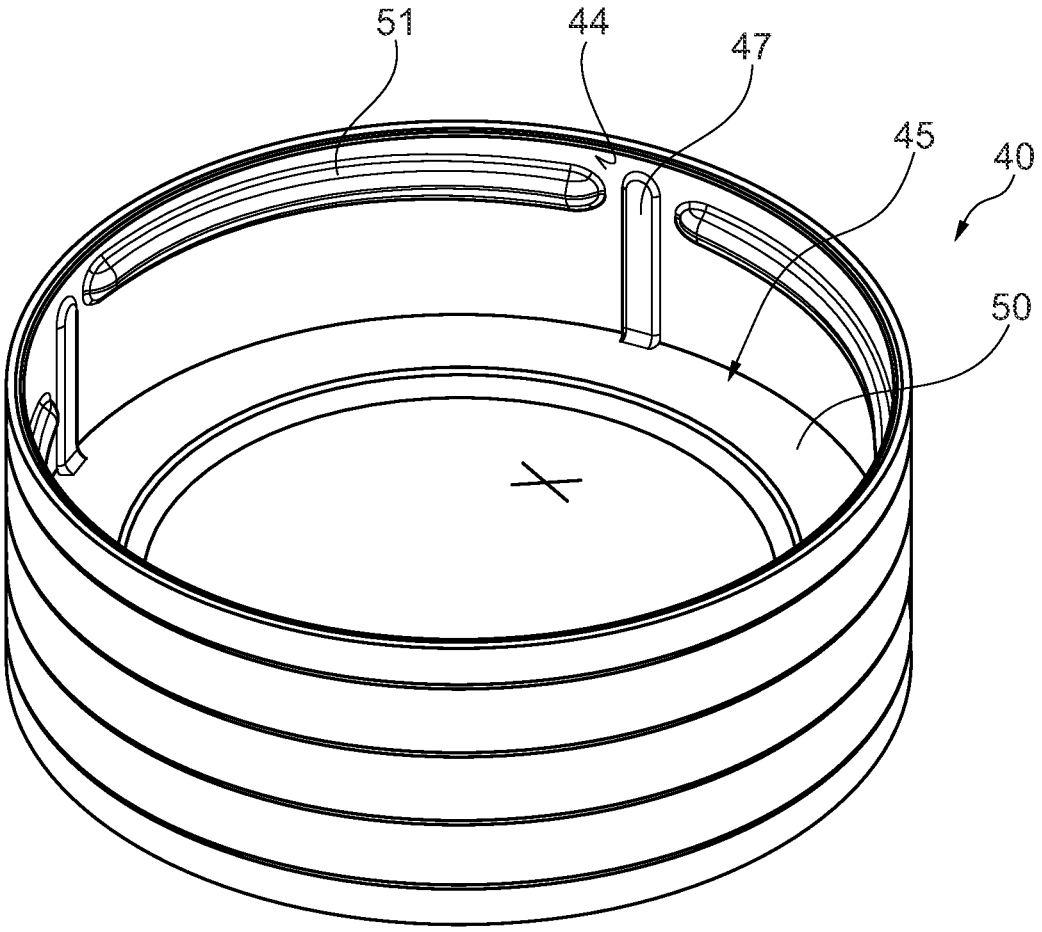
FIG. 7 shows an isometric view and bottom view of the closing cap shown in FIG. 6.

As previously described with reference to the exemplary embodiment of closing cap 11 shown in particular in FIG. 5, contacting material unit 45 is also applied on inner side 44 of base body 42 in an injection molding process in the present case.

Contacting material strands 47 extend between thread turn segments 51 which are formed on inner side 44 of base body 42 and are made of the same material as base body 42, i.e., aluminum, in the case at hand, meaning the forces in the screw connection are essentially transmitted via the thread turn segments 51 made of the material of base body 42 in the case of the exemplary embodiment of closing cap 40 shown in FIGS. 6 to 10, contacting material strands 47 ensuring a radial support and enabling an elastically resilient reduction of the forces acting in the screw connection owing to their material quality and thus contributing to increasing the haptic quality during the screwing process.

The invention claimed is:

1. A closing cap (11, 40) for a container (10, 41) for receiving cosmetic creams, liquids or pasty substances, the closing cap (11, 40) being designed as a material hybrid and having a connective area for establishing a connection realized as a screw connection or bayonet connection between the closing cap (11, 40) and the container (10, 41), the connective area being formed on an inner side (15, 44) of a base body (12, 42) made of metal, plastic or ceramics, wherein the connective area has a plastic material as a contacting material (22) in a first portion for forming a physical contact between the closing cap (11, 44) and the container (10, 41) and a second portion of the closing cap (11, 44) is made of the same material as the base body (12, 42);

wherein the contacting material (22) forms a thread turn (18) of a cap thread (16) formed on the inner side (15) of the base body (12); and wherein a depression bottom (30) of a thread depression (31) formed between axially adjacent profile flanks (29) of the thread turn (18) does not have the contacting material (22).

2. The according to claim 1, wherein the volumetric or weight portion of the contacting material (22) is less than or equal to 8%.

3. The closing cap according to claim 1, wherein the contacting material (22) comprises a thermoplastic material, which is soft compared to the material of the second portion of the closing cap (11, 40).

4. The closing cap according to claim 1, wherein the contacting material (22) is adapted to form a cap seal (17) between the base body (12) and an opening edge (34) of a container opening of the container (10).

5. The closing cap according to claim 4, wherein the cap seal (17) is an annular or circular surface.

6. The closing cap according to claim 1, wherein the thread turn (18) and the cap seal (17) are made of a continuous contacting material unit (23).

7. The closing cap according to claim 1, wherein the thread turn (18) has a profile (27) having profile flanks (29) tapering off in the transition area to the surface (28) of the base body (12).

8. The closing cap according to claim 1, wherein the thread turn (18) is made up of thread turn segments spaced apart from each other in the direction of the thread turn (18).

9. The closing cap according to claim 1, wherein the thread turn (18) is an acme thread.

10. The closing cap according to claim 1, characterized in that the contacting material (22) forms contacting protrusions on the inner side (44) of the base body (42) between thread turn segments (51) formed on the inner side (44) of the base body (42).

11. The closing cap according to claim 10, characterized in that the contacting material (22) forms a cap seal (50) between the base body (42) and an opening edge of a container opening of the container (41).

12. The closing cap according to claim 10, characterized in that the thread turn segments (51) are made of the same material as the base body (42).

13. The closing cap according to claim 10 characterized in that the contacting protrusions are realized as a plurality of contacting material strands (47) which extend in the axial direction within the connective area.

14. The closing cap according to claim 13, characterized in that the contacting material strands (47) form a contacting material unit (45), a central part combining the individual contact strands (47) serving for forming a cap seal (50).

15. The closing cap according to claim 1, characterized in that the base body (12, 42) of the closing cap (11, 40) forms an inner cap disposed in an outer cap (13, 49) of the closing cap.

16. A container (10, 41) for receiving cosmetic creams, liquids or pasty substances, such as in particular Mascara, the container comprising a closing cap (11, 40) according to claim 1.

17. A method for producing a closing cap (11, 40) according to claim 1, characterized in that the contacting material (22) is applied to the surface of the inner side (15, 44) of the base body (12, 42) in a coating process.

18. The method according to claim 17, characterized in that the contacting material (22) is applied in a molding process.

19. The method according to claim 18, characterized in that the contacting material (22) is applied to the surface of the inner side (15, 44) of the base body (12, 42) in an injection molding process.

* * * * *